US008015964B2

(12) United States Patent
Eddy

(10) Patent No.: US 8,015,964 B2
(45) Date of Patent: Sep. 13, 2011

(54) SELECTIVE DISPLACEMENT CONTROL OF MULTI-PLUNGER FUEL PUMP

(76) Inventor: David Norman Eddy, East Peoria, IL (US)

( * ) Notice: Subject to any disclaimer, the term of this patent is extended or adjusted under 35 U.S.C. 154(b) by 800 days.

(21) Appl. No.: 11/586,594

(22) Filed: Oct. 26, 2006

(65) Prior Publication Data

US 2008/0098991 A1 May 1, 2008

(51) Int. Cl.
*F02M 37/06* (2006.01)
*F04B 49/03* (2006.01)

(52) U.S. Cl. ..... 123/504; 123/506; 417/213; 417/216

(58) Field of Classification Search ..... 123/495, 123/446, 447, 456, 497, 496, 504, 506; 417/2, 417/212, 213, 216, 218
See application file for complete search history.

(56) References Cited

U.S. PATENT DOCUMENTS 1,736,242 A 11/1929 Attendu
2,225,773 A 9/1941 Heftler
2,428,408 A 10/1947 Beeh
3,614,944 A 10/1971 Ulbing
4,100,903 A 7/1978 Roosa
4,325,342 A 4/1982 Kohler et al.
4,345,559 A 8/1982 Kuttner et al.
4,478,196 A 10/1984 Hafner et al.
4,694,789 A 9/1987 Frost
4,766,863 A 8/1988 Fujimori
4,884,549 A 12/1989 Kelly
4,922,869 A 5/1990 Kadomukai et al.
4,977,508 A 12/1990 Tanaka et al.
5,000,151 A 3/1991 Eisele et al.
5,094,216 A 3/1992 Miyaki et al.
5,111,784 A 5/1992 Kuriyama et al.
5,133,645 A 7/1992 Crowley et al.
5,197,438 A 3/1993 Kumano et al.
5,230,613 A 7/1993 Hilsbos et al.
5,271,366 A 12/1993 Shimada et al.
5,332,061 A 7/1994 Majeed et al.
5,527,156 A * 6/1996 Song ..... 417/2
5,564,391 A 10/1996 Barnes et al.
5,685,275 A 11/1997 Djordjevic
(Continued)

FOREIGN PATENT DOCUMENTS

EP 1072781 A2 1/2001
(Continued)

OTHER PUBLICATIONS

PCT International Search Report, File Ref. No. 06-851; PCT/US2007/022720; Filing Date: Oct. 26, 2007; Applicant: Caterpillar Inc.

(Continued)

*Primary Examiner* — Willis R Wolfe, Jr.
(74) *Attorney, Agent, or Firm* — Finnegan, Henderson, Farabow, Garrett & Dunner LLP; Carl E. Myers

(57) ABSTRACT

A pump for a combustion engine is disclosed. The pump may have at least one pumping member movable through a plurality of displacement strokes during a single engine cycle. The pump may also have a controller in communication with the pumping member. The controller may be configured to selectively reduce an amount of fluid displaced during at least one, but less than all of the plurality of displacement strokes. The reduction may be initiated in response to a demand for the displaced fluid.

21 Claims, 3 Drawing Sheets

U.S. PATENT DOCUMENTS

| | | | | |
|---|---|---|---|---|
| 5,697,343 | A | 12/1997 | Isozumi et al. | |
| 5,881,698 | A | 3/1999 | Tuckey et al. | |
| 6,095,118 | A * | 8/2000 | Klinger et al. | 123/446 |
| 6,142,125 | A | 11/2000 | Shimayama et al. | |
| 6,257,204 | B1 | 7/2001 | Kamijo et al. | |
| 6,318,343 | B1 | 11/2001 | Nakagawa et al. | |
| 6,336,070 | B1 | 1/2002 | Lorenz et al. | |
| 6,336,445 | B1 * | 1/2002 | Yamazaki et al. | 123/506 |
| 6,672,290 | B2 * | 1/2004 | Ricco | 123/514 |
| 6,705,297 | B2 | 3/2004 | Takeda et al. | |
| 6,913,447 | B2 | 7/2005 | Fox et al. | |
| 6,978,769 | B2 | 12/2005 | Hoglund et al. | |
| 7,121,261 | B2 | 10/2006 | Kinose | |
| 7,182,067 | B2 | 2/2007 | Ricco et al. | |
| 7,406,949 | B2 | 8/2008 | Puckett | |
| 7,559,313 | B2 | 7/2009 | Tokuo et al. | |
| 2002/0078928 | A1 | 6/2002 | Onishi et al. | |
| 2006/0000446 | A1 | 1/2006 | Ricco et al. | |
| 2007/0217925 | A1 | 9/2007 | Tian et al. | |
| 2008/0109152 | A1 | 5/2008 | Puckett | |
| 2009/0241911 | A1 | 10/2009 | Fox et al. | |

FOREIGN PATENT DOCUMENTS

| | | | |
|---|---|---|---|
| EP | 1 241 349 | A2 | 9/2002 |
| EP | 1327766 | A2 | 7/2003 |
| EP | 1 669 579 | | 6/2006 |
| EP | 1 683 954 | A1 | 7/2006 |
| EP | 1741912 | A2 | 1/2007 |
| JP | 2006112609 | A * | 4/2006 |

OTHER PUBLICATIONS

Daniel R. Puckett, U.S. Appl. No. 11/593,005, filed Nov. 6, 2006, entitled "Selective Displacement Control of Multi-Plunger Fuel Pump".

Tyler M. Nester et al., "Experimental Observations of Centrifugal Pendulum Vibration Absorbers," The 10$^{th}$ Annual Symposium on Transport Phenomena and Dynamics of Rotating Machinery, Mar. 7-11, 2004.

* cited by examiner

RELATIONSHIP OF PUMPING EVENTS TO INJECTION EVENTS

SELECTIVE DISPLACEMENT CONTROL OF MULTI-PLUNGER FUEL PUMP

TECHNICAL FIELD

The present disclosure relates generally to a fuel pump, and more particularly to a system for selectively controlling the displacement of individual plungers within a multiple plunger fuel pump.

BACKGROUND

Common rail fuel systems typically employ multiple injectors connected to a common rail that is provided with high pressure fuel. In order to efficiently accommodate the different combinations of injections at a variety of timings and injection amounts, the systems generally include a variable discharge pump in fluid communication with the common rail. One type of variable discharge pump is the cam driven, inlet or outlet metered pump.

A cam driven, inlet or outlet metered pump generally includes multiple plungers, each plunger being disposed within an individual pumping chamber. The plunger is connected to a lobed cam by way of a follower, such that, as a crankshaft of an associated engine rotates, the cam likewise rotates and the connected lobe(s) reciprocatingly drives the plunger to displace fuel from the pumping chamber into the common rail. The amount of fuel pumped by the plunger into the common rail depends on the amount of fuel metered into the pumping chamber prior to the displacing movement of the plunger, or the amount of fluid spilled (i.e., metered) to a low-pressure reservoir during the displacing stroke of the plunger.

One example of a cam driven, outlet metered pump is described in U.S. Patent Publication No. 2006/0120880 (the '880 publication) by Shafer et al. published on Jun. 8, 2006. Specifically, the '880 publication teaches a pump having a housing that defines a first pumping chamber and a second pumping chamber. The pump also includes first and second plungers slidably disposed within the first and second pumping chambers and movable between first and second spaced apart end positions to pressurize a fluid. The pump further includes a first cam having three lobes operatively engaged with the first plunger, and a second cam having three lobes operatively engaged with the second plunger to move each of the first and second plungers between the first and second end positions six times during a complete cycle of the engine. The pump additionally includes a common spill passageway fluidly connectable to the first and second pumping chambers, and a control valve in fluid communication with the spill passageway. The control valve is movable to selectively spill fluid from the first and second pumping chambers to a low-pressure gallery to thereby change the effective displacement of the first and second plungers.

Although the cam driven outlet metered pump of the '880 publication may effectively pressurize fuel for a common rail system, it may be problematic. In particular, during each stroke of each plunger, significant force is directed from the plunger back through the respective cams, through a cam gear arrangement, and to a crankshaft of the associated engine. Although these forces by themselves might be insufficient to cause damage to the cams or cam gear arrangement, when coupled with other opposing forces such as those caused by combustion of the fuel, a significant hammering affect on the cams and/or cam gear arrangement may be observed. For example, when injectors of the same common rail system inject fuel to initiate combustion within the engine, resultant forces acting on the pistons of the engine travel down the connecting rod of each piston, through the crankshaft in reverse direction to the pump initiated forces, and into the cam gear arrangement. When the pump initiated forces and the injection initiated forces overlap (i.e., occur at the same time), the resultant force can be significant enough to cause damage to the cam gear arrangement and/or the cams of the fuel pump. Further, the forces acting on the components of the fuel system add to the overall noise of the engine, particularly when there is an overlap in the pump and injection initiated forces.

The disclosed fuel pump is directed to overcoming one or more of the problems set forth above.

SUMMARY OF THE INVENTION

In one aspect, the present disclosure is directed to a pump for a combustion engine. The pump may include at least one pumping member movable through a plurality of displacement strokes during a single engine cycle. The pump may also include a controller in communication with the at least one pumping member and being configured to selectively reduce an amount of fluid displaced during at least one, but less than all of the plurality of displacement strokes. The reduction may be initiated in response to a demand for the displaced fluid.

In another aspect, the present disclosure is directed to a method of pressurizing a fluid. The method may include pressurizing fluid multiple times during a single engine cycle. The method may also include selectively reducing an amount of fluid pressurized during at least one of the times, but less than all times in response to a demand for the pressurized fluid.

DETAILED DESCRIPTION

Figure 1:
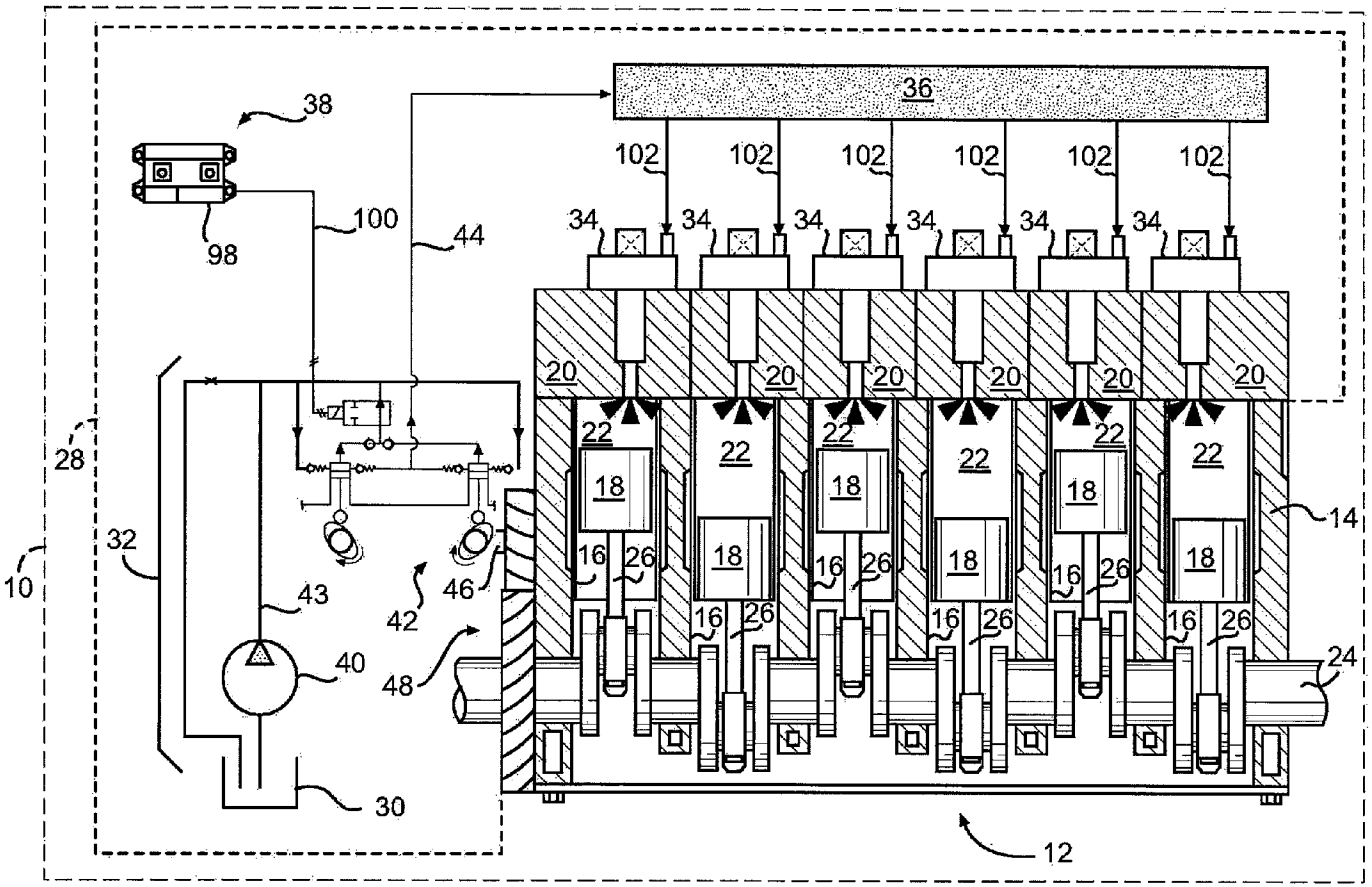
FIG. 1 is a schematic and diagrammatic illustration of an exemplary disclosed common rail fuel system.

FIG. 1 illustrates a power system 10 having an engine 12 and an exemplary embodiment of a fuel system 28. Power system 10, for the purposes of this disclosure, is depicted and described as a four-stroke diesel engine. One skilled in the art will recognize, however, that engine 12 may be any other type of internal combustion engine such as, for example, a gasoline or a gaseous fuel powered engine.

As illustrated in FIG. 1, engine 12 may include an engine block 14 that defines a plurality of cylinders 16. A piston 18 may be slidably disposed within each cylinder 16, and engine 12 may also include a cylinder head 20 associated with each cylinder 16. Cylinder 16, piston 18, and cylinder head 20 may form a combustion chamber 22. In the illustrated embodiment, engine 12 includes six combustion chambers 22. One skilled in the art will readily recognize, however, that engine 12 may include a greater or lesser number of combustion chambers 22 and that combustion chambers 22 may be disposed in an "in-line" configuration, a "V" configuration, or any other conventional configuration.

Engine 12 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 28 may include components driven by crankshaft 24 to deliver injections of pressurized fuel into each combustion chamber 22. Specifically, fuel system 28 may include a tank 30 configured to hold a supply of fuel, a fuel pumping arrangement 32 configured to pressurize the fuel and direct the pressurized fuel to a plurality of fuel injectors 34 by way of a manifold 36 (i.e., common rail), and a control system 38.

Fuel pumping arrangement 32 may include one or more pumping devices that function to increase the pressure of the fuel and direct one or more pressurized streams of fuel to manifold 36. In one example, fuel pumping arrangement 32 includes a low-pressure source 40 and a high-pressure source 42. Low-pressure source 40 may embody a transfer pump that provides low-pressure feed to high-pressure source 42 via a passageway 43. High-pressure source 42 may receive the low-pressure feed and increase the pressure of the fuel to about 300 MPa. High-pressure source 42 may be connected to manifold 36 by way of a fuel line 44. One or more filtering elements (not shown), such as a primary filter and a secondary filter, may be disposed within fuel line 44 in series relation to remove debris and/or water from the fuel pressurized by fuel pumping arrangement 32, if desired.

One or both of low and high-pressure sources 40, 42 may be operatively connected to engine 12 and driven by crankshaft 24. Low and/or high-pressure sources 40, 42 may be connected with crankshaft 24 in any manner readily apparent to one skilled in the art where a rotation of crankshaft 24 will result in a corresponding driving rotation of a pump shaft. For example, a pump driveshaft 46 of high-pressure source 42 is shown in FIG. 1 as being connected to crankshaft 24 through a cam gear arrangement 48. It is contemplated, however, that one or both of low and high-pressure sources 40, 42 may alternatively be driven electrically, hydraulically, pneumatically, or in any other appropriate manner.

Figure 2:
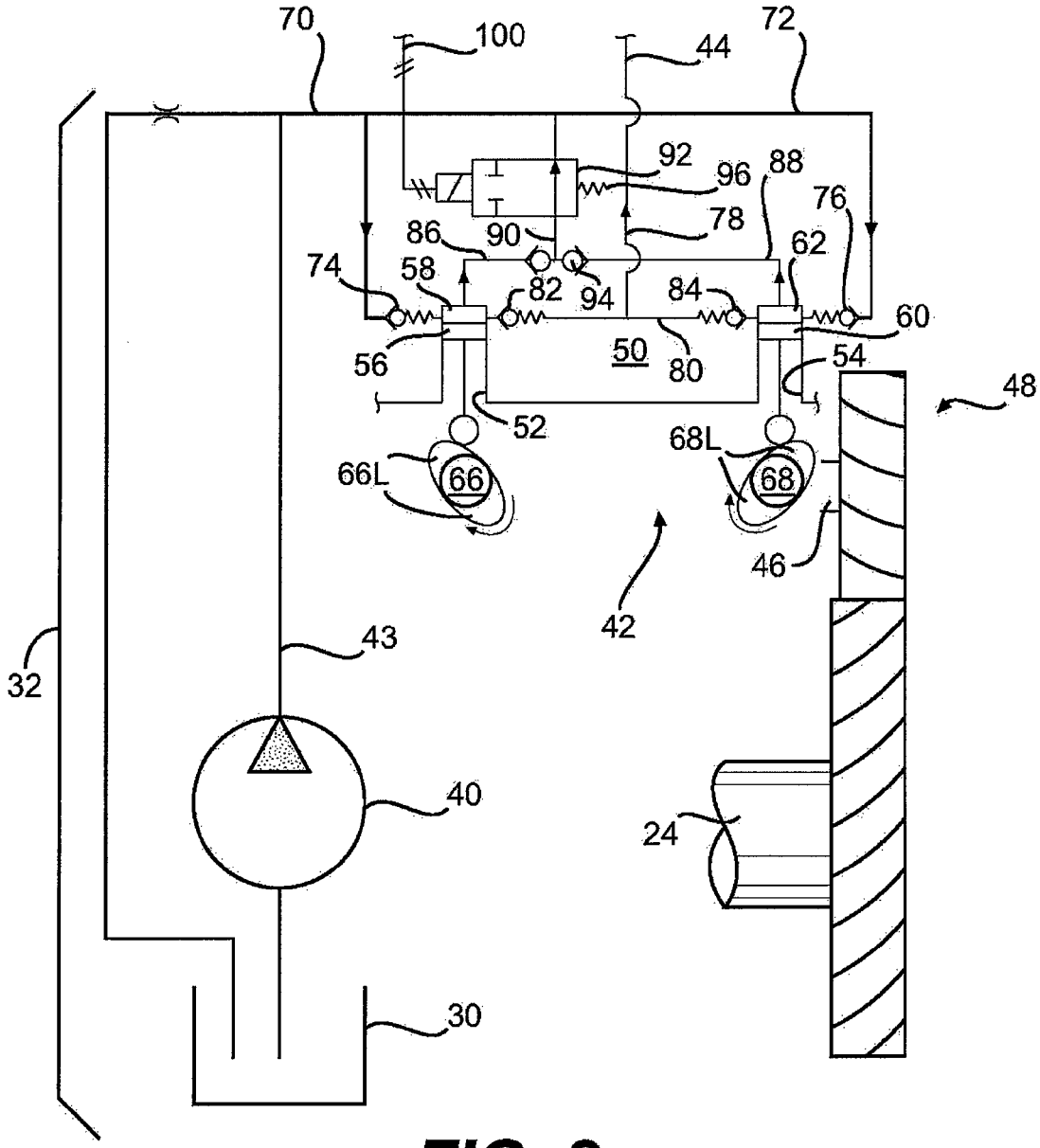
FIG. 2 is a schematic and diagrammatic illustration of an exemplary disclosed fuel pump for use with the common rail fuel system of FIG. 1.

As illustrated in FIG. 2, high-pressure source 42 may include a housing 50 defining a first and second barrel 52, 54. High-pressure source 42 may also include a first plunger 56 slidably disposed within first barrel 52 such that, together, first plunger 56 and first barrel 52 may define a first pumping chamber 58. High-pressure source 42 may also include a second plunger 60 slidably disposed within second barrel 54 such that, together, second plunger 60 and second barrel 54 may define a second pumping chamber 62. It is contemplated that additional pumping chambers may be included within high-pressure source 42, if desired.

A first and second driver 66, 68 may operatively connect the rotation of crankshaft 24 to first and second plungers 56, 60, respectively. First and second drivers 66, 68 may include any means for driving first and second plungers 56, 60 such as, for example, a cam, a swashplate, a wobble plate, a solenoid actuator, a piezo actuator, a hydraulic actuator, a motor, or any other driving means known in the art. In the example of FIG. 2, first and second drivers 66, 68 are cams, each cam having two cam lobes 66L and 68L, respectively, such that a single full rotation of first driver 66 may result in two corresponding reciprocations between two spaced apart end positions of first plunger 56, and a single full rotation of second driver 68 may result in two similar corresponding reciprocations of second plunger 60.

Cam gear arrangement 48 may be configured such that during a single full engine cycle (i.e., the movement of piston 18 through an intake stroke, compression stroke, power stroke, and exhaust stroke or two full rotations of crankshaft 24), pump driveshaft 46 may rotate each of drivers 66 and 68 two times. Thus, each of first and second plungers 56, 60 may reciprocate within their respective barrels four times for a given engine cycle to produce a total of eight pumping strokes. First and second drivers 66, 68 may be positioned relative to each other such that first and second plungers 56, 60 are caused to reciprocate out of phase with one another and the eight pumping strokes are equally distributed relative to the rotational angle of crankshaft 24. It is contemplated that first and second drivers 66, 68, if embodied as lobed cams, may alternatively include any number of lobes to produce a corresponding number of pumping strokes. It is also contemplated that a single driver may move both first and second plungers 56, 60 between their respective end positions, if desired.

High-pressure source 42 may include an inlet 70 fluidly connecting high-pressure source 42 to passageway 43. High-pressure source 42 may also include a low-pressure gallery 72 in fluid communication with inlet 70 and in selective communication with first and second pumping chambers 58, 62. A first inlet check valve 74 may be disposed between low-pressure gallery 72 and first pumping chamber 58 to allow a unidirectional flow of low-pressure fuel into first pumping chamber 58. A second similar inlet check valve 76 may be disposed between low-pressure gallery 72 and second pumping chamber 62 to allow a unidirectional flow of low-pressure fuel into second pumping chamber 62.

High-pressure source 42 may also include an outlet 78, fluidly connecting high-pressure source 42 to fuel line 44. High-pressure source 42 may include a high-pressure gallery 80 in selective fluid communication with first and second pumping chambers 58, 62 and outlet 78. A first outlet check valve 82 may be disposed between first pumping chamber 58 and high-pressure gallery 80 to allow displaced fluid from first pumping chamber 58 into high-pressure gallery 80. A second outlet check valve 84 may be disposed between second pumping chamber 62 and high-pressure gallery 80 to allow fluid displaced from second pumping chamber 62 into high-pressure gallery 80.

High-pressure source 42 may also include a first spill passageway 86 selectively fluidly connecting first pumping chamber 58 with a common spill passageway 90, and a second spill passageway 88 fluidly communicating second pumping chamber 62 with common spill passageway 90. A spill control valve 92 may be disposed within common spill passageway 90 between first and second spill passageways 86, 88 and low-pressure gallery 72 to selectively allow some of the fluid displaced from first and second pumping chambers 58, 62 to flow through first and second spill passageways 86, 88 and into low-pressure gallery 72. The amount of fluid displaced (i.e., spilled) from first and second pumping chambers 58, 62 into low-pressure gallery 72 may be inversely proportional to the amount of fluid displaced (i.e., pumped) into high-pressure gallery 80.

The fluid connection between pumping chambers 58, 62 and low-pressure gallery 72 may be established by way of a selector valve 94 such that only one of first and second pumping chambers 58, 62 may fluidly connect to low-pressure gallery 72 at a time. Because first and second plungers 56, 60 may move out of phase relative to one another, one pumping chamber may be at high-pressure (pumping stroke) when the other pumping chamber is at low-pressure (intake stroke), and vice versa. This action may be exploited to move an element of selector valve 94 back and forth to fluidly connect either first spill passageway 86 to spill control valve 92, or second spill passageway 88 to spill control valve 92. Thus, first and second pumping chambers 58, 62 may share a common spill control valve 92. It is contemplated, however, that a separate spill control valve may alternatively be dedicated to controlling the effective displacement of each individual pumping chamber, if desired. It is further contemplated that rather than metering an amount of fuel spilled from first and second pumping chambers 58, 62 (also know as outlet metering), the amount of fuel drawn into and subsequently displaced from first and second pumping chambers may alternatively be metered (also known as inlet metering).

Spill control valve 92 may be normally biased toward a first position where fluid is allowed to flow into low-pressure gallery 72, as shown in FIG. 2, via a biasing spring 96. Spill control valve 92 may also be moved by way of a solenoid or pilot force to a second position where fluid is blocked from flowing into low-pressure gallery 72. The movement timing of spill control valve 92 between the flow passing and flow blocking positions relative to the displacement position of first and/or second plungers 56, 60, may determine what fraction of the fluid displaced from the respective pumping chambers spills to low-pressure gallery 72 or is pumped to high-pressure gallery 80.

Fuel injectors 34 may be disposed within cylinder heads 20 and connected to manifold 36 by way of distribution lines 102 to inject the fuel displaced from first and second pumping chambers 58, 62. Fuel injectors 34 may embody, for example, electronically actuated—electronically controlled injectors, mechanically actuated—electronically controlled injectors, digitally controlled fuel valves, or any other type of fuel injectors known in the art. Each fuel injector 34 may be operable to inject an amount of pressurized fuel into an associated combustion chamber 22 at predetermined timings, fuel pressures, and fuel flow rates. The timing of fuel injection into combustion chamber 22 may be synchronized with the motion of piston 18 and thus the rotation of crankshaft 24. For example, fuel may be injected as piston 18 nears a top-dead-center (TDC) position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for aftertreatment regeneration. The combustion resulting from the injection of fuel may generate a force on piston 18 that travels through connecting rod 26 and crankshaft 24 to rotate cam gear arrangement 48 for pressurizing of additional fuel.

Control system 38 (referring to FIG. 1) may control what amount of fluid displaced from first and second pumping chambers 58, 62 is spilled to low-pressure gallery 72 and what amount is pumped through high-pressure gallery 80 to manifold 36 for subsequent injection and combustion. Specifically, control system 38 may include an electronic control module (ECM) 98 in communication with spill control valve 92. Control signals generated by ECM 98 directed to spill control valve 92 via a communication line 100 may determine the opening and closing timing for spill control valve 92 that results in a desired fuel flow rate to manifold 36 and/or a desired fuel pressure within manifold 36.

ECM 98 may embody a single microprocessor or multiple microprocessors that include a means for controlling the operation of fuel system 28. Numerous commercially available microprocessors can be configured to perform the functions of ECM 98. It should be appreciated that ECM 98 could readily embody a general engine or power system microprocessor capable of controlling numerous and diverse functions. ECM 98 may include a memory, a secondary storage device, a processor, and any other components for running an application. Various other circuits may be associated with ECM 98 such as power supply circuitry, signal conditioning circuitry, solenoid driver circuitry, and other types of circuitry.

ECM 98 may selectively open and close spill control valve 92 to spill or pump fuel in response to a demand. That is, depending on the rotational speed of engine 12 and the load on engine 12, a predetermined amount of fuel must be injected and combusted in order to provide a required engine speed and/or torque output. In order for injectors 34 to inject this predetermined amount of fuel, a certain quantity and pressure of the fuel must be present within manifold 36 at the time of injection. ECM 98 may include one or more maps stored in a memory thereof relating various engine conditions and or sensory input to the required quantity of fuel. Each of these maps may be in the form of tables, graphs, and/or equations and include a compilation of data collected from lab and/or field operation of engine 12. ECM 98 may reference these maps and/or sensory input and open or close spill control valve 92 such that first and second plungers 56, 60 displace the required amount of fuel to manifold 36 at the correct timing.

Figure 3:
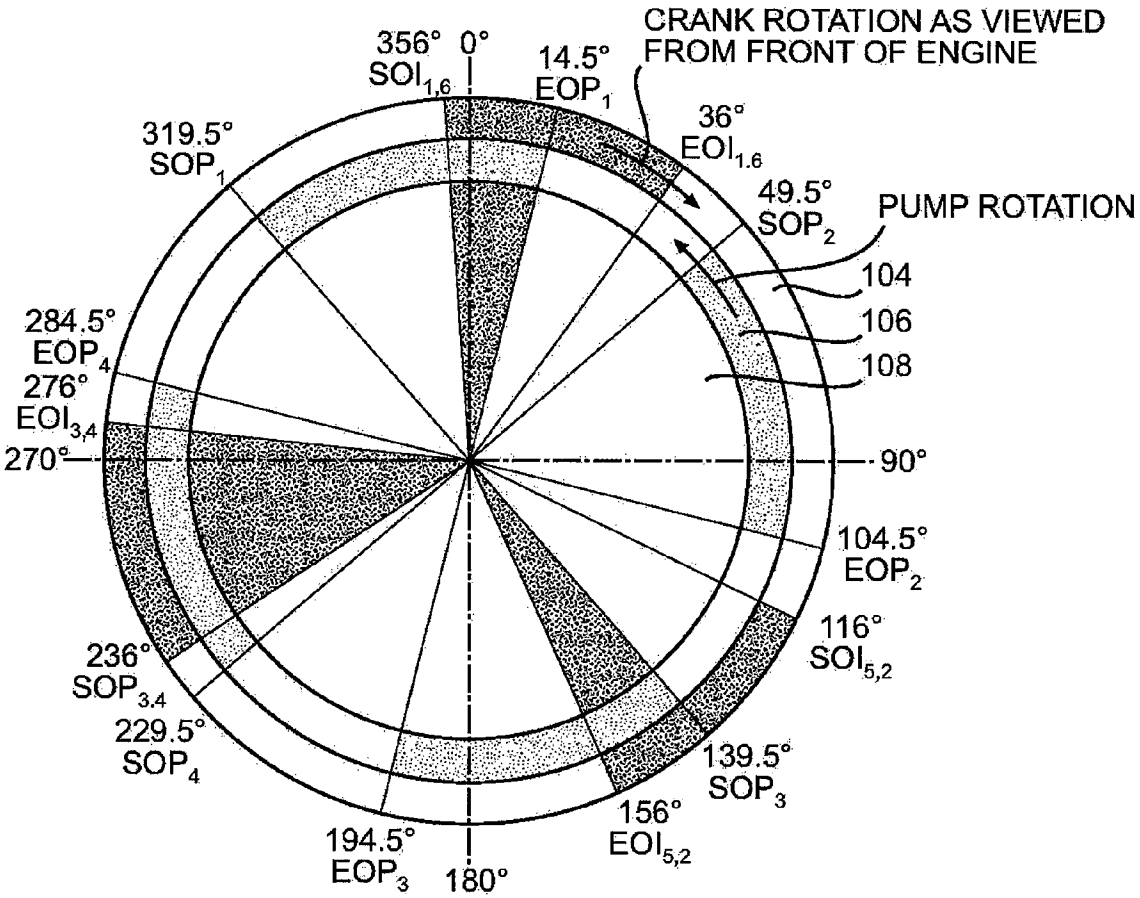
FIG. 3 is a control diagram depicting exemplary disclosed timings of events associated with operation of the common rail fuel system of FIG. 1.

As illustrated in FIG. 3, in some situations, the displacing strokes of first and second plungers 56, 60 may correspond with the injection timing of fuel injectors 34. Specifically, FIG. 3 illustrates an exemplary injection timing of fuel injectors 34 generally designated by the darker regions in a outer annulus 104, and exemplary stroke timing of first and second plungers 56, 60 generally designated by the darker regions in a mid-located annulus 106. The darker regions of an inner annulus 108 indicates the angular overlap in crankshaft timing between injection events and displacing strokes.

As can be seen from outer annulus 104, for every complete engine cycle (i.e., two rotations of crankshaft 24), fuel injectors 34 may inject fuel six different times (i.e., one injection for each fuel injector 34). In particular, the injections of fuel from fuel injectors 34 numbered 1-6 (counting from left to right in FIG. 1), may start at 716°, 116°, 236°, 356°, 476°, 596° of crankshaft revolution (labeled as $SOI_{1-6}$ in FIG. 3), respectively, and end at 36°, 156°, 276°, 396, 516°, 636° (labeled as $EOI_{1-6}$ in FIG. 3), respectively.

As can be seen from mid-located annulus 106, for every complete engine cycle, first and second plungers 56, 60 may move through a displacing stroke four times each, for a combined total of eight strokes. That is, first plunger 56 may start a first displacing stroke at 679.5° (labeled as $SOP_1$ in FIG. 3), followed by a second displacing stroke of second plunger 60 starting at 49.5° ($SOP_2$). The first displacing stroke may end at 14.5° (labeled as $EOP_1$ in FIG. 3), while the second displacing stroke may end at 104.5° ($EOP_2$). The ensuing $3^{rd}$-$8^{th}$ displacing strokes may continue in this manner, with first plunger 56 alternating displacing strokes with second plunger 60 such that $SOP_3$ occurs at 139.5°, $SOP_4$ occurs at 229.5°, $SOP_5$ occurs at 319.5°, $SOP_6$ occurs at 409.5, $SOP_7$ occurs at 499.5°, and $SOP_8$ occurs at 589.5°. Similarly, the $3^{rd}$-$8^{th}$ displacing strokes may end at an $EOP_3$ of 194.5°, an $EOP_4$ of 284.5°, an $EOP_5$ of 374.5°, an $EOP_6$ of 464.5°, an $EOP_7$ of 554.5°, and an $EOP_8$ of 644.5°.

As can be seen from inner annulus 108, for every complete engine cycle, four displacing strokes of high-pressure source 42 (i.e., strokes 1, 3, 5, and 7) may overlap at least partially with four fuel injection events (i.e., the injection events of fuel injectors 1, 2, 5, and 6). Two displacing strokes of high-pressure source 42 (i.e., strokes 4 and 8) may overlap almost completely with two fuel injection events (i.e., the injection events of fuel injectors 3 and 4). The two remaining displacing strokes of high-pressure source 42 (i.e., strokes 2 and 6) may not be coincident with any injection events. Because the forces experienced by first and second drivers 66, 68, cam gear arrangement 48, and crankshaft 24 may be a sum of the forces imparted by first and second plungers 56, 60 and by pistons 18 during the combustion of injected fuel, the overlapping injection events described above may, if left unchecked, result in significant and possibly even damaging forces.

To minimize the magnitude of these resultant forces, ECM 98 may selectively vary (i.e., reduce) the amount fuel pumped by first and/or second plungers 56, 60 into manifold 36. For example, ECM 98 may selectively and significantly reduce the effective displacement of the strokes 4 and 8 described above, and/or moderately reduce the effective displacement of strokes 1, 3, 5, and 7. By reducing these effective displacement amounts, the duration of the overlap between completely coincident pumping strokes and injection events may be minimized, thereby minimizing the duration of the high magnitude forces. In addition, by reducing effective displacement amounts associated with partially coincident pumping strokes and injection events, it may be possible to not only minimize the duration of the high magnitude forces, but to even eliminate the overlap altogether.

Multiple strategies may be utilized to reduce the displacement of individual pumping strokes. One such strategy may include keeping one or more of the pumping strokes at full displacement, while reducing the remaining pumping strokes by an equal amount. For example, pumping strokes 1-3 and 5-7 may be kept at full displacement, while strokes 4 and 8 may be reduced by an equal amount of 50% of a maximum displacement capacity. Another strategy may include keeping one or more of the pumping strokes at full displacement, while reducing a first stroke by a first amount, a second stroke by a second amount, a third stroke by a third amount, etc. For example, pumping strokes 2 and 6 may be kept at full displacement, strokes 1, 3, 5, and 7 may be reduced by a small amount of 25%, and strokes 4 and 8 may be reduced by a greater amount of 50%. In yet another example, the pumping strokes of only one of first and second plungers 56, 60 may be displacement reduced. For example, pumping strokes 1, 3, 5, and 7 corresponding with the motion of first plunger 56 may be kept at full displacement, while only strokes 2, 4, 6, and 8 that correspond with the motion of second plunger 60 may be reduced. Regardless of the strategy implemented, it may be best to reduce the displacement of those strokes most coincident (i.e. having the most overlap) with injection events. It may also be desirable in some situations to minimize or even prevent the displacement reduction of consecutive pumping strokes such that interruptions in the supply of fuel to manifold 36 may be minimal or nonexistent.

The reduction in pumping strokes may be initiated in response to a demand for fuel. That is, if the demand for fuel is at a maximum value, it may be impossible to reduce the displacement of any pumping strokes and still supply the demanded fuel quantity, regardless of overlap with injection events. As the demand for fuel falls away from the maximum value, the effective displacement reductions may begin to occur, and the reductions may become more dramatic as the demand for fuel within manifold 36 continues to drop. For example, as the fuel demand drops from 100% of a maximum supply rate to 75%, the effective displacement of first and second plungers 56, 60 may be reduced by a corresponding amount of about 25%. This reduction amount may correspond with the complete displacement reduction of pumping strokes 4 and 8, or the 50% effective displacement reduction of pumping strokes 4 and 8 and the 25% effective displacement reduction of pumping strokes 1, 3, 5, and 7. Alternatively, the 25% fuel demand reduction may result in a 30% effective displacement reduction of pumping stroke 4, a 20% effective displacement reduction of pumping stroke 8, a 12% effective displacement reduction of pumping stroke 1, a 10% effective displacement reduction of pumping stroke 3, an 8% effective displacement reduction of pumping stroke 5, and a 5% effective displacement reduction of pumping stroke 7. Any combination of individual displacement reductions may be instituted so long as the combined effective displacement rate (i.e., displacement amount per engine cycle) is sufficient to meet the fuelling demands of engine 12. The exact strategy for displacement reduction may vary and depend, for example, on engine speed, engine load, type of engine, engine application, desired fuel consumption, exhaust emissions, pump efficiency, resulting force magnitude, and other factors known in the art.

INDUSTRIAL APPLICABILITY

The disclosed pump finds potential application in any fluid system where it is desirous to control discharge from a pump in a manner that reduces resulting forces and damage on the fluid system. The disclosed pump finds particular applicability in fuel injection systems, especially common rail fuel injection systems for an internal combustion engine. One skilled in the art will recognize that the disclosed pump could be utilized in relation to other fluid systems that may or may not be associated with an internal combustion engine. For example, the disclosed pump could be utilized in relation to fluid systems for internal combustion engines that use a non-fuel hydraulic medium, such as engine lubricating oil. The fluid systems may be used to actuate various sub-systems such as, for example, hydraulically actuated fuel injectors or gas exchange valves used for engine braking. A pump according to the present disclosure could also be substituted for a pair of unit pumps in other fuel systems, including those that do not include a common rail.

Referring to FIG. 1, when fuel system 28 is in operation, first and second drivers 66, 68 may rotate causing first and second plungers 56, 60 to reciprocate within respective first and second barrels 52, 54, out of phase with one another. When first plunger 56 moves through the intake stroke, second plunger 60 may move through the pumping stroke.

During the intake stroke of first plunger 56, fluid may be drawn into first pumping chamber 58 via first inlet check valve 74. As first plunger 56 begins the pumping stroke, the increasing fluid pressure within first pumping chamber 58 may cause selector valve 94 to move and allow displaced fluid to flow (i.e., spill) from first pumping chamber 58 through spill control valve 92 to low-pressure gallery 72. When it is desirous to output high-pressure (i.e., pump) fluid from high-pressure source 42, spill control valve 92 may move to block fluid flow from first pumping chamber 58 to low-pressure gallery 72.

Closing spill control valve 92 may cause an immediate build up of pressure within first pumping chamber 58. As the pressure continues to increase within first pumping chamber 58, a pressure differential across first outlet check valve 82 may produce an opening force that exceeds a spring closing force of first outlet check valve 82. When the spring closing force of first outlet check valve 82 has been surpassed, first outlet check valve 82 may open and high-pressure fluid from within first pumping chamber 58 may flow through first outlet check valve 82 into high-pressure gallery 80 and then into manifold 36 by way of fluid line 44.

One skilled in the art will appreciate that the timing at which spill control valve 92 closes and/or opens may determine what fraction of the amount of fluid displaced by the first plunger 56 is pumped into the high-pressure gallery 80 and what fraction is pumped back to low-pressure gallery 72. This operation may serve as a means by which pressure can be maintained and controlled in manifold 36. As noted in the previous section, control of spill valve 92 may be provided by signals received from ECM 98 over communication line 100.

Toward the end of the pumping stroke, as the angle of cam lobe 66L causing first plunger 56 to move decreases, the reciprocating speed of first plunger 56 may proportionally decrease. As the reciprocating speed of first plunger 56 decreases, the opening force caused by the pressure differential across first outlet check valve 82 may near and then fall below the spring force of first outlet check valve 82. First outlet check valve 82 may move to block fluid therethrough when the opening force caused by the pressure differential falls below the spring force of first outlet check valve 82.

As second plunger 60 switches modes from filling to pumping (and first plunger 56 switches from pumping to filling), selector valve 94 may move to block fluid flow from first pumping chamber 58 and open the path between second pumping chamber 62 and spill control valve 92, thereby allowing spill control valve 92 to control the discharge of second pumping chamber 62. Second plunger 60 may then complete a pumping stroke similar to that described above with respect to first plunger 56.

During any one of the pumping strokes of first and second plungers 56, 60, the effective displacement (i.e., the ratio of the amount of fuel pumped to the amount of fuel spilled) thereof may be individually reduced to minimize the forces transmitted through first and/or second drivers 66, 68, cam gear arrangement 48, and crankshaft 24. The effective displacement reduction may be made by keeping spill control valve 92 in the open position for a greater period of time during the start of the pumping stroke or, alternatively, by opening spill control valve 92 at a time before the end of the pumping stroke of the respective plunger. ECM 98 may institute this reduced effective displacement in response to anticipated, known, and/or measured overlapping injection events and a demand for fuel being less than a maximum output capacity of high-pressure source 42. As the demand for fuel decreases the amount of effective displacement reduction may be increased and/or the effective displacement of other pumping strokes may be additionally and incrementally reduced according to a number of different strategies stored within the memory of ECM 98.

Several advantages may be realized because the individual pumping strokes of first and/or second plungers 56, 60 may be selectively displacement reduced. For example, the forces resulting from the displacement strokes of first and/or second plungers 56, 60 may be reduced to below a component damaging threshold, thereby extending the component lift of fuel system 28 and reducing the engine's overall noise level. In addition, by reducing the effective displacement of the pumping strokes, the operating cost of high-pressure source 42 may also be reduce by only outputting pressurized fuel as demanded and by outputting the pressurized fuel with as few of the pumping strokes as possible. That is, by utilizing fewer than all of the pumping strokes (i.e., reducing one or more of the pumping strokes completely), the displacement of the remaining strokes (the strokes with no or little overlap with an injection event) may be increased proportionally, possibly to their maximum displacement values according to the fuel demand. Fewer strokes at a greater displacement may be more efficient than more strokes at a lower displacement.

It will be apparent to those skilled in the art that various modifications and variations can be made to the pump of the present disclosure. Other embodiments of the pump will be apparent to those skilled in the art from consideration of the specification and practice of the pump disclosed herein. It is intended that the specification and examples be considered as exemplary only, with a true scope being indicated by the following claims and their equivalents.

What is claimed is:

1. A pump for a combustion engine having at least one fuel injector, comprising:

at least one pumping member movable through a plurality of displacement strokes during a single engine cycle; and a controller configured to selectively reduce an amount of fluid displaced by the at least one pumping member during at least one displacement stroke, but less than all of the plurality of displacement strokes in response to a demand for the displaced fluid, the at least one displacement stroke being selected by the controller for reduction based on an injection timing so as to overlap at least partially with an injection of the at least one fuel injector to reduce a force associated with the pumping member during combustion of fuel injected by the injector, the controller causing the pump to displace at least some fluid during the at least one displacement stroke selected for reduction.

2. The pump of claim 1, wherein the amount of fluid displaced is reduced for more than one of the plurality of displacement strokes and the reduction amount for each of the more than one of the plurality of displacement strokes is substantially the same.

3. The pump of claim 1, wherein the combustion engine has a plurality of fuel injectors; and the at least one displacement stroke includes a plurality of displacement strokes that are selected by the controller for reduction based on the injection timing so as to overlap at least partially with injections of the plurality of fuel injectors.

4. The pump of claim 1, wherein the amount of fluid displaced is reduced for more than one of the plurality of displacement strokes and each of the more than one of the plurality of displacement strokes are non-consecutive.

5. The pump of claim 1, wherein:

the at least one pumping member includes a first pumping member and a second pumping member; and the displacement strokes having a reduced fluid displacement amount correspond with only one of the first and second pumping members.

6. The pump of claim 1, wherein an amount that the at least one displacement stroke is reduced is substantially proportional to a synchronicity of the at least one displacement stroke with the injection of the at least one fuel injector.

7. The pump of claim 1, wherein an amount that the at least one displacement stroke is reduced is based on the demand for the displaced fluid.

8. The pump of claim 1, wherein:

the amount of fluid displaced is reduced for more than one of the plurality of displacement strokes; and the reduction amount for each of the more than one of the plurality of displacement strokes is different, wherein the reduction amount for each of the more than one of the plurality of displacement strokes is proportional to an amount of overlap of each of the one or more displacement strokes with an injection of the at least one fuel injector.

9. The pump of claim 1, wherein the amount of fluid displaced is reduced for more than one of the plurality of displacement strokes and the reduction amount for each of the more than one of the plurality of displacement strokes is different.

10. The pump of claim 9, wherein a one of the more than one of the plurality of displacement strokes having a greatest reduction in the fluid displacement amount is selected for reduction by the controller based on the injection timing so as to overlap most completely with the injection of the at least one fuel injector.

11. The pump of claim 1, wherein the controller is configured to selectively attenuate an injection force of the at least one fuel injector with a pumping force of the at least one pumping member.

12. The pump of claim 11, wherein the force attenuation results in a noise reduction.

13. The pump of claim 11, wherein the force attenuation is initiated based on a reduced fuel demand.

14. A combustion engine, comprising:

a fuel pump, including:

a housing at least partially defining a first pumping chamber and a second pumping chamber;

a first plunger slidingly disposed within the first pumping chamber;

a first cam mechanism rotationally driven to move the first plunger between first and second spaced apart end positions to pressurize fuel multiple times during a complete engine cycle;

a second cam mechanism rotationally driven to move the second plunger between the first and second spaced apart end positions out of phase with the first plunger to pressurize fuel multiple times during the complete engine cycle; and a controller configured to reduce the amount of fuel pressurized by individual movements of the first and second plungers independent of other movements of the first and second plungers during the complete engine cycle;

an engine block at least partially defining a combustion chamber;

a fuel injector configured to inject the pressurized fuel into the combustion chamber at a predetermined injection timing during the complete engine cycle; and a crankshaft configured to reciprocatingly drive a piston within the combustion chamber and to rotationally drive the fuel pump, wherein the individual movements of the first and second plungers pressurizing a reduced amount of fuel are selected by the controller based on injection timing so as to overlap at least partially with an injection of the fuel injector to reduce a force associated with at least one of the first and second plungers during combustion of fuel infected by the injector, and wherein the individual movements of the first and second plungers pressurizing a reduced amount of fuel displace at least some fuel.

15. The combustion engine of claim 14, wherein the amount of fuel pressurized by at least one of the movements of the first and second plungers during the complete engine cycle remains at a maximum amount.

16. The combustion engine of claim 14, wherein the amount of fuel pressurized by each of multiple movements of the first and second plungers within the engine cycle is reduced by the same amount.

17. The combustion engine of claim 14, wherein the amount of fuel pressurized by each of multiple movements of the first and second plungers within the engine cycle is reduced by a different amount.

18. The combustion engine of claim 14, wherein the movements of the first and second plungers having a reduced amount of pressurized fuel are non-consecutive.

19. The combustion engine of claim 14, wherein the amount of fuel pressurized by the movements of only the first plunger are reduced.

20. The combustion engine of claim 14, wherein the movement of the first and second plungers overlapping most precisely with the injection of the fuel injector is selected by the controller based on the injection timing to be reduced the most.

21. The engine of claim 14, wherein the controller is configured to selectively attenuate an injection force of the at least one fuel injector with a pumping force of at least one of the first and second plungers.

* * * * *